United States Patent [19]

Sutor et al.

[11] 4,209,966

[45] Jul. 1, 1980

[54] TERMINABLE COMMUNICATION CABLE WITH CONDUCTOR PAIRS COMBINED IN GROUPS

[75] Inventors: Norbert Sutor, Neustadt; Dieter Vogelsberg, Coburg, both of Fed. Rep. of Germany

[73] Assignee: Siemens Aktiengesellschaft, Munich, Fed. Rep. of Germany

[21] Appl. No.: 942,317

[22] Filed: Sep. 14, 1978

[30] Foreign Application Priority Data

Sep. 16, 1977 [DE] Fed. Rep. of Germany ..... 2742368

[51] Int. Cl.[2] ..... H01B 13/02; H01B 13/26

[52] U.S. Cl. ..... 57/6; 57/7; 57/314

[58] Field of Search ..... 57/3, 6, 32, 7, 13–15, 57/314; 174/117 F, 117 R, 117 A, 24, 27, 32

[56] References Cited

U.S. PATENT DOCUMENTS

| | | | |
|---|---|---|---|
| 1,655,106 | 1/1928 | Parsons et al. | 57/6 |
| 1,664,231 | 3/1928 | Thomas | 57/314 X |
| 1,970,376 | 8/1934 | Hamburger | 57/32 X |
| 2,321,512 | 6/1943 | Protz | 57/7 X |
| 2,566,973 | 9/1951 | Yake | 57/6 |
| 2,790,299 | 4/1957 | Gillis et al. | 57/314 X |
| 3,098,342 | 7/1963 | Smith | 57/7 X |
| 3,631,662 | 1/1972 | Bienfait | 57/13 |
| 3,695,027 | 10/1972 | Copp | 57/32 X |
| 3,793,816 | 2/1974 | Kodama | 57/7 |

*Primary Examiner*—John Petrakes

*Attorney, Agent, or Firm*—Kenyon & Kenyon

[57] ABSTRACT

To provide symmetrical communication cables, especially wiring cables for telephone exchange installations, with connectors at the cable ends, in a simple manner, the individual groups of pairs of the cable core consist of a flat cable, which is formed into a group by twisting or torsioning. The pairs of each flat cable are connected to each other by means of flexible holding elements which are cemented or welded to the pairs on one side. In the manufacture of such a communication cable, the pairs of a group are first arranged along the generatrix of a cylinder and are temporarily secured in this configuration by means of a holding helix. The holding helix is cemented or welded to the surface of the pairs and subsequently cut open between two adjacent pairs in the same operation.

5 Claims, 6 Drawing Figures

TERMINABLE COMMUNICATION CABLE WITH CONDUCTOR PAIRS COMBINED IN GROUPS

BACKGROUND OF THE INVENTION

This invention relates to communication cables in general and more particularly to the mechanical design of a symmetrical communication cable such as is used, for instance, for wiring purposes in telephone exchange installations, and the design of which takes into consideration the possibility of terminating the cable ends, i.e., assembling connectors automatically, and also to a method and apparatus of manufacturing such a cable.

In the manufacture of symmetrical communication cables, the individual twisting elements such as pairs, triplets or quads are twisted in layers or groups to form the cable core. If communication cables are built up in groups, this has advantages with respect to the mounting of fittings and with respect to wiring. For instance, five spiral quads or five to ten conductor pairs can be twisted to form a base group and subsequently, several such base groups twisted to form a main group. Such a main group or several such main groups form the cable core (German Petty Patent No. 66 07 289).

In one known symmetrical communication cable of group design, several such conductor pairs are combined in pair groups which are twisted together to form the cable core which is surrounded by a cable sheath. The pairs of each pair group form a kind of flat cable, inasmuch as the pairs are connected to each other transversely to the lengthwise direction of the conductors by means of flexible holding elements arranged at regular intervals. The flexible holding elements can each consist of two plastic strips which are welded or cemented together laterally to the pairs (German Offenlegungsschrift No. 17 65 463). Through such a design of the communication cable, which is provided particularly as a wiring cable for telephone exchange installations, the cost for marking the individual conductors and pairs as well as for the wiring of the cable ends can be reduced. In another cable of this type, the conductors of each conductor group (base group) are arranged side by side on a tape-like carrier and the carrier with the conductors is formed into a tabular structure which represents the base group (German Offenlagungsschrift No. 20 21 875). In addition, a wiring cable consisting of a so-called ribbon cable is known in which the ribbon cable is alternatingly folded right and left for improving its flexibility and is enclosed by a sheath (U.S. Pat. No. 2,004,612). Ribbon cables, in which a number of individual insulated conductors is fastened via their insulation to a common carrier member, can be fabricated, incidentally, by first arranging the conductors about a fixed arbor, then spray-molding the conductors on their sides facing away from the arbor with a common plastic sheath and by finally cutting open the plastic sheath between two conductors parallel to the latter, after the arbor has been removed, and bending it open to form the carrier member (German Auslegeschrift No. 15 15 813).

SUMMARY OF THE INVENTION

Starting out from the symmetrical communication cable mentioned at the outset, the cable core of which, surrounded by a cable sheath, consists essentially of one or more conductor groups which in turn consist of several twisted pairs, where the pairs of each conductor group are connected to each other transversely to the lengthwise direction of the conductors by means of flexible holding elements arranged at regular intervals and form a flat cable, it is an object of the present invention to improve the mechanical design of such a cable with respect to its flexibility, electrical properties (crosstalk) and efficient production and to provide a method particularly well suited for the manufacture of such a cable as well as apparatus suitable for implementing the method.

To solve this problem, which is related to the mechanical design of the communication cable, according to the present invention, the flexible holding elements comprise elongated members, i.e., filaments or tapes secured, i.e., cemented or welded, to the pairs on one side or of a holding helix which is wrapped on the adjacent conductor pairs and is cemented or welded to the conductor pairs, and the pairs of each group are formed into a round group and are combined, i.e., twisted or torsioned together.

In a communication cable designed in this manner, the individual conductor groups can be manufactured continuously through the cross connection of the conductors of each conductor group by means of filaments or tapes cemented or spot welded to the conductor insulation, very good flexibility of each conductor group in the longitudinal direction as well as in the transversal direction is obtained. Further, by twisting or torsioning the pairs formed into a group, relatively low crosstalk is obtained between the pairs of adjacent conductor groups. In particular with respect to the manufacture of such a communication cable, the advantages also present with the already known design are fully brought to bear, namely, the possibility of manufacturing the cable continuously in one or at most two operations, by first making several pairs in parallel from individual conductors by means of the so-called SZ twisting process, immediately thereafter forming these into the flat cable by means of the holding element and by making the flat cable into a group (bundle) and twisting or torsioning it, for instance, by means of an SZ twisting process. Several such groups can subsequently be twisted together in a second operation and enclosed with a cable sheath.

Particularly well suited for manufacturing the new communication cable is a method in which a flat cable is temporarily formed from several conductor pairs and in which, according to a further embodiment of the invention, the pairs are first arranged along the generatrices of a cylinder and are temporarily fixed in this configuration by means of a holding helix, where the holding helix is cemented or welded to the surface of the conductor pairs and in which the holding helix is subsequently cut open between two conductor pairs associated with adjacent generatrices in the same operation and the pairs connected crosswise to each other by means of the cut open holding helix are formed into a group, leaving the generatrices of the cylinder, and are twisted or torsioned together to form the conductor group. In this manner, the holding elements, by which the individual pairs of a conductor group are connected to each other transversely to the lengthwise direction of the conductors, are applied in one continuous operation.

In a further embodiment of the manufacturing method provided by the present invention, an apparatus which is particularly well suited for implementing the present invention includes stationary hole plates for guiding the conductor pairs, behind which a cylindrical arbor is arranged extending along the axis of the hole plate, and with which are associated a disc-like guide section for coordinating the conductor pairs with the generatrices of the arbor, a spinner for applying the holding helix, a device for cementing or welding the holding helix to the conductor pairs and a device for cutting open the cemented or welded holding helix. Following the arbor is a device for twisting the conductor pairs to form the conductor group.

Such an arrangement can be adapted through a different choice of the arbor diameter, to different numbers of conductor pairs. Further, the mutual spacing of the pairs of a conductor group can be varied by changing the dimension of the arbor.

DETAILED DESCRIPTION OF THE INVENTION

Figure 1:
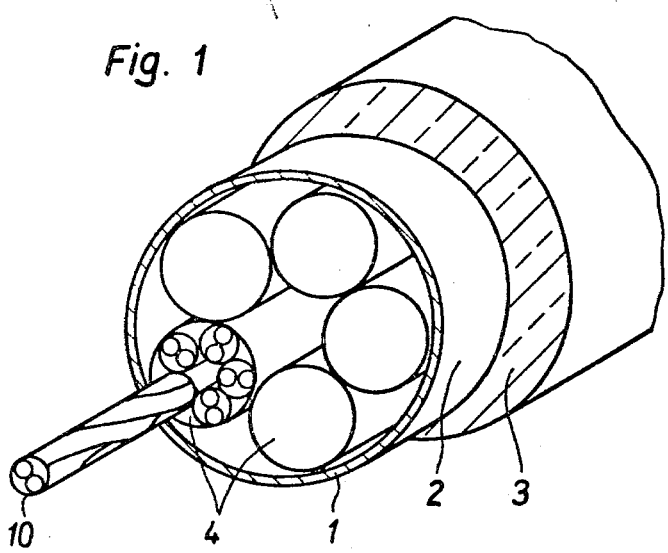
FIG. 1 is a perspective view, in cross-section of a cable according to the present invention.
Figure 2:
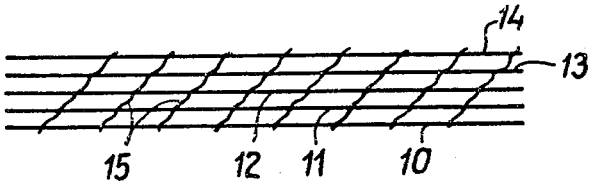
FIG. 2 is a diagrammatic plan view of a flat cable made in accordance with the present invention.

FIG. 1 shows a communication cable, the cable core of which includes the main group 1 which is surrounded by a metal tape 2 formed into a tube inserted longitudinally and by a cable sheath consisting of a plastic sheath 3. The main group 1 comprises five base groups 4 twisted together and each base group 4 comprises a conductor group designed in accordance with the invention. Several parallel conductor pairs, for instance, the conductor pairs 10 to 14 according to FIG. 2 are formed into a flat cable by means of holding elements 15 running transversely to the longitudinal direction of the conductors. The holding elements 15 are arranged on one side of the conductor pairs 10 to 14 and are cemented or welded to the insulation of the conductors. Because the manufacturing process is continuous, the holding elements 15 are not perpendicular to the longitudinal direction of the conductors, but at an angle thereto.

Figure 3:
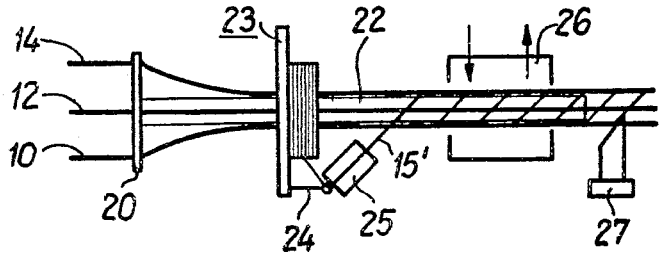
FIG. 3 is a diagrammatic elevation view of apparatus for making the flat cable of FIG. 2.
Figure 4:
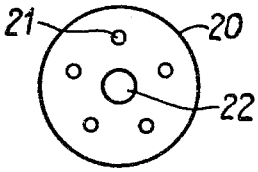
FIG. 4 is a plan view of the stationary hole plate of FIG. 3.

The conductor group consisting of the conductor pairs 10 to 14 is produced on manufacturing apparatus diagrammatically shown in FIG. 3. The latter comprises essentially a stationary hole plate 20 which has guide holes 21 arranged symmetrically about its axis, as shown in FIG. 4, for guiding the conductor pairs 10 to 14 and behind which a cylindrical arbor 22 is arranged which extends along the axis of the hole plate. Disposed concentrically with arbor 22 is a central spinner 23, which at the same time contains a disc shaped guide piece for fixing the conductor pairs 10 to 14 on generatrices of the cylindrical arbor 22. By means of the spinner 23, a holding helix 15' is wrapped onto the conductor pairs 10 to 14; this helix, after leaving the spinner arm 24, passes through a device 25 co-rotating with the spinner, for applying an adhesive to the holding helix 15. By virtue of this adhesive, the holding helix 15 is cemented to the surface of the conductor pairs 10 to 14; the solvent of the adhesive is evaporated and exhausted by means of an exhaust device 26.

Figure 5:
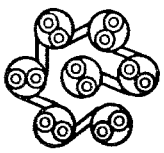
FIGS. 5 and 6 are end views illustrating the configuration of a base group of seven conductor pairs after folding or winding in spiral fashion.
Figure 6:
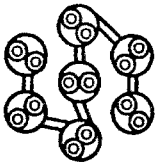

Behind the end of the arbor 22, a cutting device 27 is arranged, by means of which the holding helix 15 is cut open between two of the conductor pairs. This completes the forming of the conductor pairs 10 to 14 into a flat cable. The latter can be formed into a base group in apparatus which is to be arranged subsequently and is known per se, for instance, by folding or by winding in spiral fashion, as is diagrammatically shown in FIGS. 5 and 6 for a base group consisting of seven conductor pairs, and the base group then torsioned or twisted. Alternatively, the flat cable can be torsioned or twisted to form the base group directly.

In the interest of making the production as efficient as possible, it is advantageous to arrange, for each conductor pair, an SZ twisting device known per se and not specifically shown, which twists the conductors, drawn off from stationary conductor supplies, together to form the conductor pairs 10 to 14 ahead of the hole plate 20.

In the later installation of a communication cable designed in accordance with the present invention, each round base group can be dissolved again and formed back into a flat cable as per FIG. 2. The individual conductor pairs no longer need to be identified, as their sequence follows from the geometry of the flat cable. The a and b wires of individual conductor pairs can be differentiated, for instance, by different coloring or other indicators. Also the counting direction within a flat cable can be determined, for instance, by a color marker at the edge.

What is claimed is:

1. The method for manufacturing a communication cable which includes a cable core, surrounded by a cable sheath, which consists of several conductor groups which in turn consists of several twisted conductor pairs, the conductor pairs of each conductor group connected to each other by means of flexible holding elements arranged at regular intervals transversely to the longitudinal direction of the conductors and form a flat cable comprising:

(a) first arranging the conductor pairs temporarily along the generatrix of a cylinder;

(b) temporarily fixing said pairs in this configuration by means of a holding helix by securing the holding helix to the surface of the conductor pairs;

(c) subsequently cutting open the holding helix between two conductor pairs associated with adjacent generatrices in the same operation;

(d) removing the several conductor pairs from this configuration to obtain a flat cable in which the conductor pairs have crosswise connection to each other by means of the cut opened holding helix; and (e) combining the conductor pairs in the flat cable into a conductor group.

2. The method according to claim 1 wherein said conductor pairs are combined by twisting together.

3. The method according to claim 1 wherein said conductor pairs are combined by torsioning them together to form the conductor group.

4. Apparatus for manufacturing a communication cable having a cable core which comprises several conductor groups, each of which comprise several twisted conductor pairs, the conductor pairs of each conductor group being connected to each other by means of flexible holding elements arranged at regular intervals transversely to the longitudinal direction of the conductors and forming a flat cable comprising:

(a) a stationary hole plate containing a plurality of holes arranged along its circumference for guiding conductor pairs, said stationary hole plate having an axis;

(b) a cylindrical arbor disposed behind said stationary hole plate extending along the axis of said hole plate;

(c) a disc shaped guide piece associated with said stationary hole plate and cylindrical arbor for coordinating the conductor pairs with the generatrices of the arbor;

(d) a spinner for applying a holding helix to said conductor pairs after they have been coordinated;

(e) means for securing the holding helix to the conductor pairs;

(f) means for cutting open the holding helix after securing, between two conductor pairs; and (g) means for twisting the conductor pairs into a conductor group following said arbor.

5. Apparatus according to claim 4 wherein said means for securing comprise means for cementing said holding helix to said conductor pairs.

* * * * *